United States Patent [19]

Katsumata et al.

[11] Patent Number: 4,770,403

[45] Date of Patent: Sep. 13, 1988

[54] PAPER FEEDER USABLE WITH A COPIER AND OTHERS

[75] Inventors: Akio Katsumata, Yokohama; Masafumi Toyofuku, Kawasaki; Kotaro Yonenaga, Yokohama, all of Japan

[73] Assignee: Ricoh Company, Ltd., Tokyo, Japan

[21] Appl. No.: 906,510

[22] Filed: Sep. 12, 1986

[30] Foreign Application Priority Data

Sep. 14, 1985 [JP] Japan ..... 60-202513
Sep. 14, 1985 [JP] Japan ..... 60-202514
Sep. 14, 1985 [JP] Japan ..... 60-202515

[51] Int. Cl.[4] ..... B65H 3/44; B65H 7/08; B65H 3/06; B65H 1/16

[52] U.S. Cl. ..... 271/9; 271/110; 271/117; 271/154

[58] Field of Search ..... 271/9, 110, 111, 117, 271/152–155, 157, 158, 159; 355/3 SH, 14 SH

[56] References Cited

U.S. PATENT DOCUMENTS 4,444,385 4/1984 Berry ..... 271/114 X

FOREIGN PATENT DOCUMENTS 47909 9/1979 Japan ..... 271/155
48501 1/1985 Japan ..... 271/9
48503 3/1985 Japan ..... 271/9
8038075 7/1981 United Kingdom ..... 271/9

*Primary Examiner*—Joseph J. Rolla
*Assistant Examiner*—Lisa C. Waag
*Attorney, Agent, or Firm*—Oblon, Fisher, Spivak, McClelland & Maier

[57] ABSTRACT

A paper feeder is disclosed which has a plurality of trays arranged one above another and a paper feed unit movable up and down to one of the trays selected. To control paper transport speed, a paper sensor is actuated prior to a level sensor during movement of the paper feed unit to a paper feed position, and a paper feed unit drive motor begins to be decelerated in response to an "on" signal of the paper sensor. The amount of papers remaining in any of the trays is detected by counting drive pulses applied to a pulse motor, which is adapted to drive the paper feed unit. After a power source has been turned on, the amounts of remaining papers in all the trays are detected and displayed prior to a copying operation.

3 Claims, 17 Drawing Sheets

| FIG. 2A |
| --- |
| FIG. 2B |

NON-VOLATILE RAM
APPARATUS I/O
ROM 8K
ROM 16K
DRIVER
DRIVER
RAM & I/O
GATE ARRAY
ADDRESS DECODER
ADDRESS LATCH
CPU
RESET
I/O
I/O
OPTION BOARD
APPA-RATUS I/O
OPERA-TING SECTION
SERVO CON-TROL

| FIG. 12A |
| --- |
| FIG. 12B |

PAPER FEEDER USABLE WITH A COPIER AND OTHERS

BACKGROUND OF THE INVENTION

The present invention relates to an independent paper feeder usable with a copier and others for feeding papers and, more particularly, to a paper feeder of the type having trays which are arranged one above another and a paper feed unit which is situated in front of the trays and caused to begin sheet feed after being elevated or lowered to a selected position. Still more particularly, the present invention relates to the control of paper transport speed and the detection of amounts of remaining papers in the trays of such a paper feeder.

A problem with a prior art paper feeder of the type described is that when the paper feed unit is moved up and down at high speed, the resultant increase in inertia prevents the unit from being stopped with accuracy at a selected paper feed position and, thereby, deteriorates the performance of the paper feeder. Typical occurrences are that papers are not fed at all and that two or more papers are fed together. Although the travelling speed of the unit may be lowered in order to enhance the accuracy with which the unit is stopped, such brings about another problem, i.e., long travel time and poor operating efficiency.

It has been customary to furnish each of the trays of the paper feeder with a sensor responsive to an amount of papers remaining in the tray. This is disadvantageous, however, since as many sensors as the trays have to be installed at the sacrifice of cost. In another known system, a remaining amount of papers is detected when the paper feed unit is stopped at a selected one of the trays. A drawback with this system is that the amounts of papers in the respective trays cannot be displayed when a power source is turned on, resulting in poor operating efficiency.

SUMMARY OF THE INVENTION

It is therefore an object of the present invention to provide a paper feeder usable with a copier and others which allows a paper feed unit thereof to be stopped with accuracy at a selected paper feed position.

It is another object of the present invention to provide a paper feeder usable with a copier and others which detects amounts of remaining papers in various trays accurately and economically without resorting to special sensor elements.

It is another object of the present invention to provide a generally improved paper feeder usable with a copier and others.

A paper feeder joined with an independent apparatus for feeding papers to the apparatus of the present invention comprises a plurality of trays arranged sequentially one above another, a paper feed unit located in front of the trays for feeding papers out of the trays, a drive motor for elevating and lowering the paper feed unit, a paper sensor for sensing presence/absence of papers, and a level sensor for sensing a level of a paper feed position where the paper feed unit is located. The paper sensor is actuated prior to the level sensor during movement of the paper feed unit to the paper feed position. The drive motor begins to be decelerated in response to an "on" signal outputted by the paper sensor.

The above and other objects, features and advantages of the present invention will become more apparent from the following detailed description taken with the accompanying drawings.

DESCRIPTION OF THE PREFERRED EMBODIMENT

Figure 1:
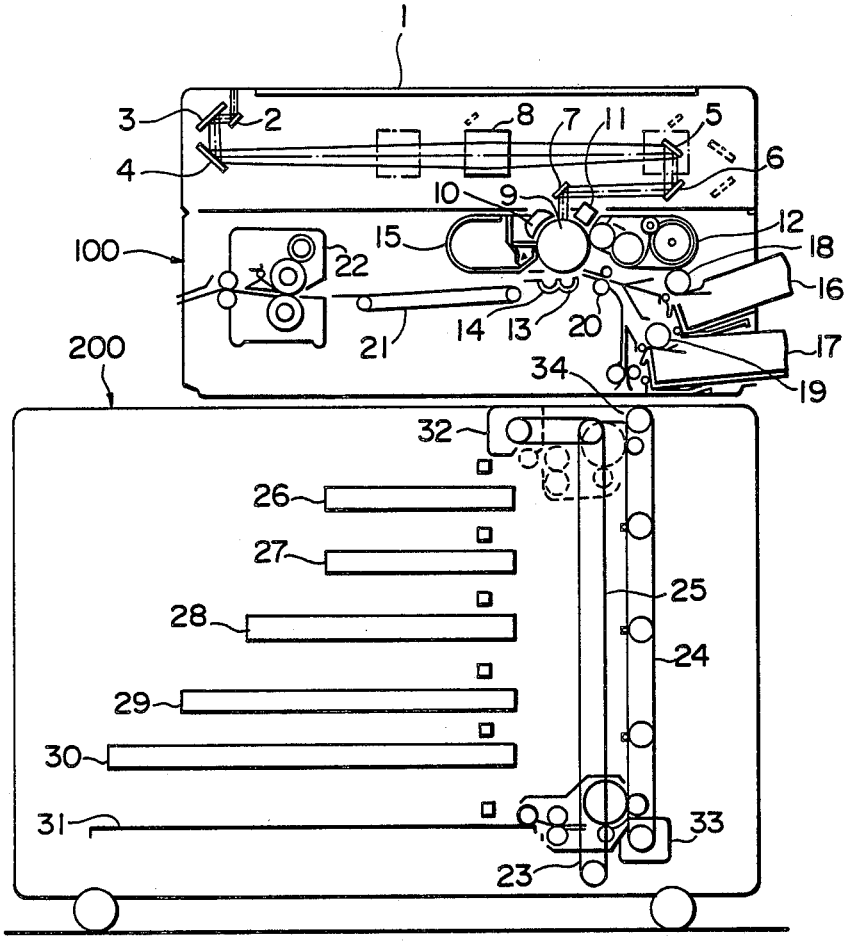
FIG. 1 is a schematic view of a copier and a paper feeder in accordance with the present invention.

Referring to FIG. 1 of the drawings, there are shown a copier and a paper feeder in accordance with the present invention. In this particular embodiment, the paper feeder, generally 200, doubles as a truck on which a copier body 100 is mounted. First, the operation of the copier body 100 will be described.

An image of a document which is laid on a glass platen 1 is focused onto a photoconductive drum 9 by mirrors 2 to 7 and a lens 8. The drum 9 on which a uniform charge has been deposited is exposed to the image to cause a latent image corresponding to the document to be formed electrostatically. A needless part of the charge on the drum 9 is removed by an eraser 11. Under this condition, the latent image is developed by a developing unit 12 and, then, transferred by a transfer charger 13 to a paper which is fed at a predetermined timing. After the image transfer, the drum 9 is cleaned by a cleaning unit 1 to remove residual toner particles and, thereby, to prepare for another copying cycle.

The movement of the paper is as follows. Papers stacked in a selected one of paper cassettes 16 and 17 are fed one by one by a feed roller 18 or 19 toward a registration roller 20. The paper temporarily stopped by the registration roller 20 is driven by the roller 20 at such a timing that the leading end of the paper becomes aligned with that of the toner image on the drum 9. After the toner image has been transferred by the charger 13 from the drum 9 to the paper, the paper is separated from the drum 9 by a separation charger 14, then transported by a belt 21 to a fixing unit 22, and then driven out of the copier with the toner image fixed thereon.

The paper feeder 200 has six trays 26 to 31 therein-side. Among these trays, the trays 26 to 30 are each movable back and forth in the right-left direction as viewed in FIG. 1 and the tray 31 alone is fixed in place. Normally, the trays 26 to 30 are retracted to positions where they do not interfere with a paper feed unit 23 which is movable up and down; only one of the trays 26 to 30 which is selected by an operator is moved horizontally to a paper feed position. This horizontal movement of the seleted tray may be implemented with a cam or the like which is so arranged as to push the rear end of the tray or, alternatively, with the vertical movement of the paper feed unit 23. The tray 31 is constantly held in a paper feed position.

The paper feed unit 23 is rigidly mounted on a drive wire 25 and movable up and down driven by a drive motor 32 as far as one of the trays which is selected by the operator. As the unit 23 reaches the selected tray, papers stacked in the tray are fed one by one from the top of the stack toward a conveyor belt 24. Driven by a drive motor 33, the belt 24 conveys the paper fed out of the unit 23 upwardly toward an opening 34 which is located at the top of the paper feeder 200. The opening 34 guides the paper toward the copier body 100. In this particular embodiment, the transport path which is defined by the belt 24 is longer than the path associated with the paper cassette 16 or 17 and, therefore, it may happen that two or more papers are present in the belt 24 during copying operation.

Taking account of the above occurrence, an arrangement is made such that the belt 24 is not stopped throughout a copying operation so as to eliminate shifts of papers due to repetitive drives and stops. An arrangement is also made such that the paper feed timing of the paper feed unit 23 is variable depending upon the position of the unit 23 so as to maintain the document scanning timing and the timing for a paper to reach the registration roller 20 constant. Specifically, the roller 20 starts driving a paper fed from the paper feeder 200 such that its leading end becomes aligned with that of an image on the drum 9, when the paper has been suitably slackened in abutment against the roller 20.

Figures 2, 2A:
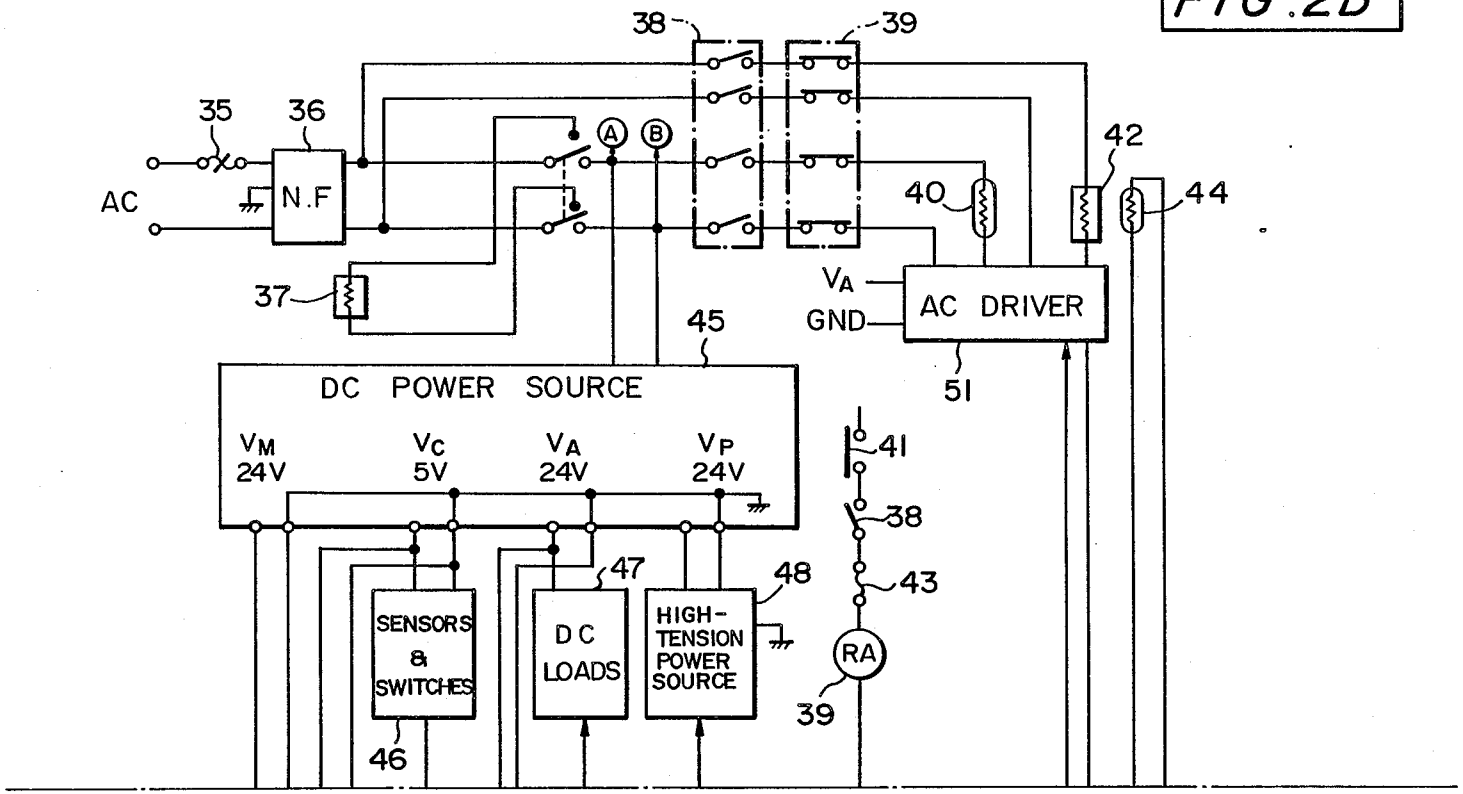
FIG. 2 is a block diagram of a control circuit which controls the whole copier and paper feeder.
Figure 2B:
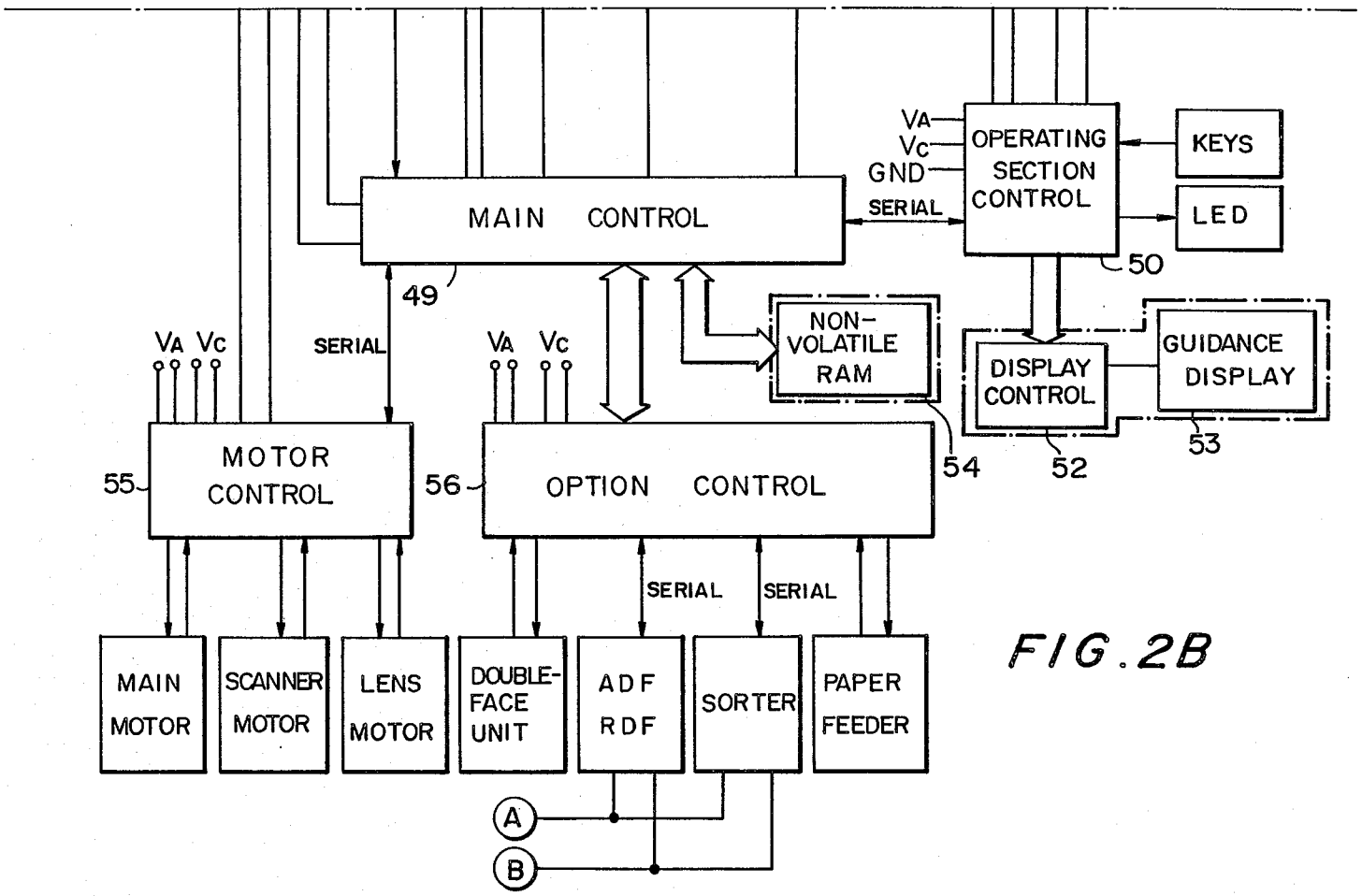

Referring to FIG. 2, a control circuit for controlling the copier 100 and paper feeder 200 is shown. In FIG. 2, the reference numeral 35 designates a circuit breaker, 36 a noise filter, and 37 a heater which is turned on only when a main switch is turned off for freeing various portions of the machine from dew condensation. A safety switch 38 turns off loads in an AC system when a door is opened. A lamp 40 serves as a light source for illuminating a document. A relay 41 deenergizes a power relay 39 when the illuminating condition of the lamp 40 is unusual. A heater 42 is associated with the fixing unit 22. A temperature fuse 43 fuses to deenergize the power relay 39 when the temperature of the heater 42 is excessively high. A thermistor 44 is adapted for the control of the heater temperature. A DC power source 45 consists of a 24 V power source ($V_P$) for a high-tension power source which will be described, a 24 V power source ($V_A$) for general DC loads, a 5 V power source ($V_C$) for control as well as for sensors and switches, and a 24 V power source ($V_M$) for motors. Machine state sensors and switches 46 are distributed in various portions of the machine, the sensors including a jam sensor, a paper size sensor and a toner end sensor. Clutches, solenoids, an erase lamp and other loads are generally designated by the reference numeral 47, the clutches including a paper feed clutch and a registration clutch. A high-tension power source 48 generates high voltage for the transfer charger and separation charger.

A main control 49 functions to control the sequence of the whole machine as well as process conditions. An operating section control 50 controls reading of inputs keyed in on an operating section and display while, at the same time, controlling the lamp 40 and heater 42. An AC driver 51 controls the lamp 40 and heater 42. A control 52 is associated with a guidance display. A liquid crystal display 53 is adapted to display various messages thereon. A non-volatile random access memory (RAM) 54 which is backed up by a battery is adapted to store various kinds of process conditions. A motor control 55 performs servo control on a main motor and a scanner motor while controlling a lens motor (pulse motor). An option control 56 functions to control various optional devices such as a double-face unit, an automatic document feeder (ADF), a recycle document feeder (RDF), a sorter, and a paper feeder. Various other units are also wired as represented by blocks in the drawing.

Figure 3:
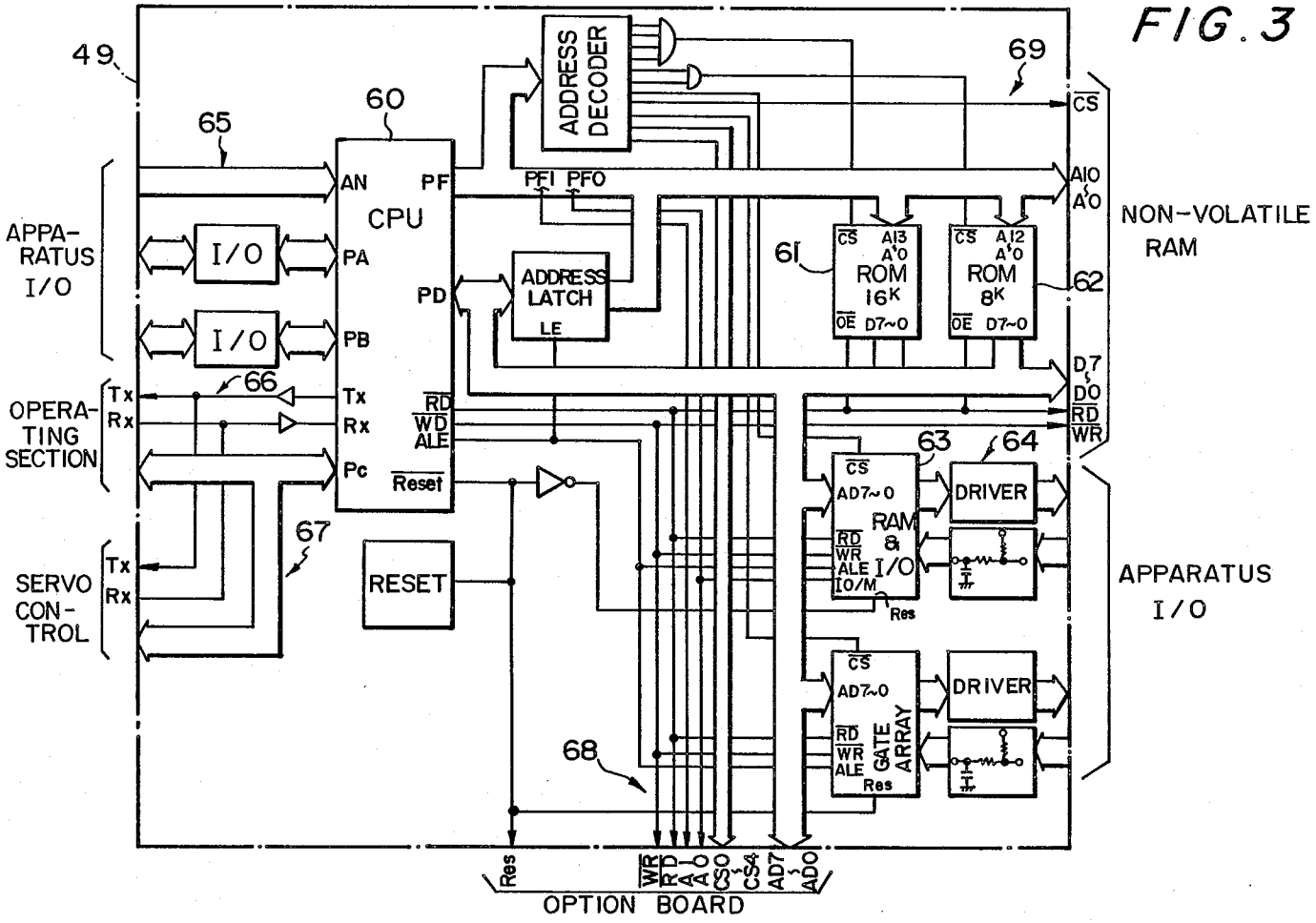
FIG. 3 is a block diagram of a main control circuit associated with the copier of FIG. 2.

FIG. 3 shows a specific construction of the main control 49 which is included in the circuitry of FIG. 2. As shown, the main control 49 consists of a central processing unit (CPU) 60, a read only memories (ROM) 61 and 62, a RAM 63, and an input/output (I/O) section (no numeral). The I/O section includes a driver 64 for driving the motors, chargers, clutches, solenoids and other loads, an input circuit to which signals from various sensors inside the copier are applied, a serial interface 66 for controlling reading of key inputs on the operating section and display, a serial interface circuit 67 for servo-controlling an optics drive motor of the copier, an option board interface 68 for controlling peripherals such as RDF, ADF, sorter, double-face unit and paper feeder, and a non-volatile RAM interface 69 for storing imaging conditions, operating modes and other data.

Figure 4:
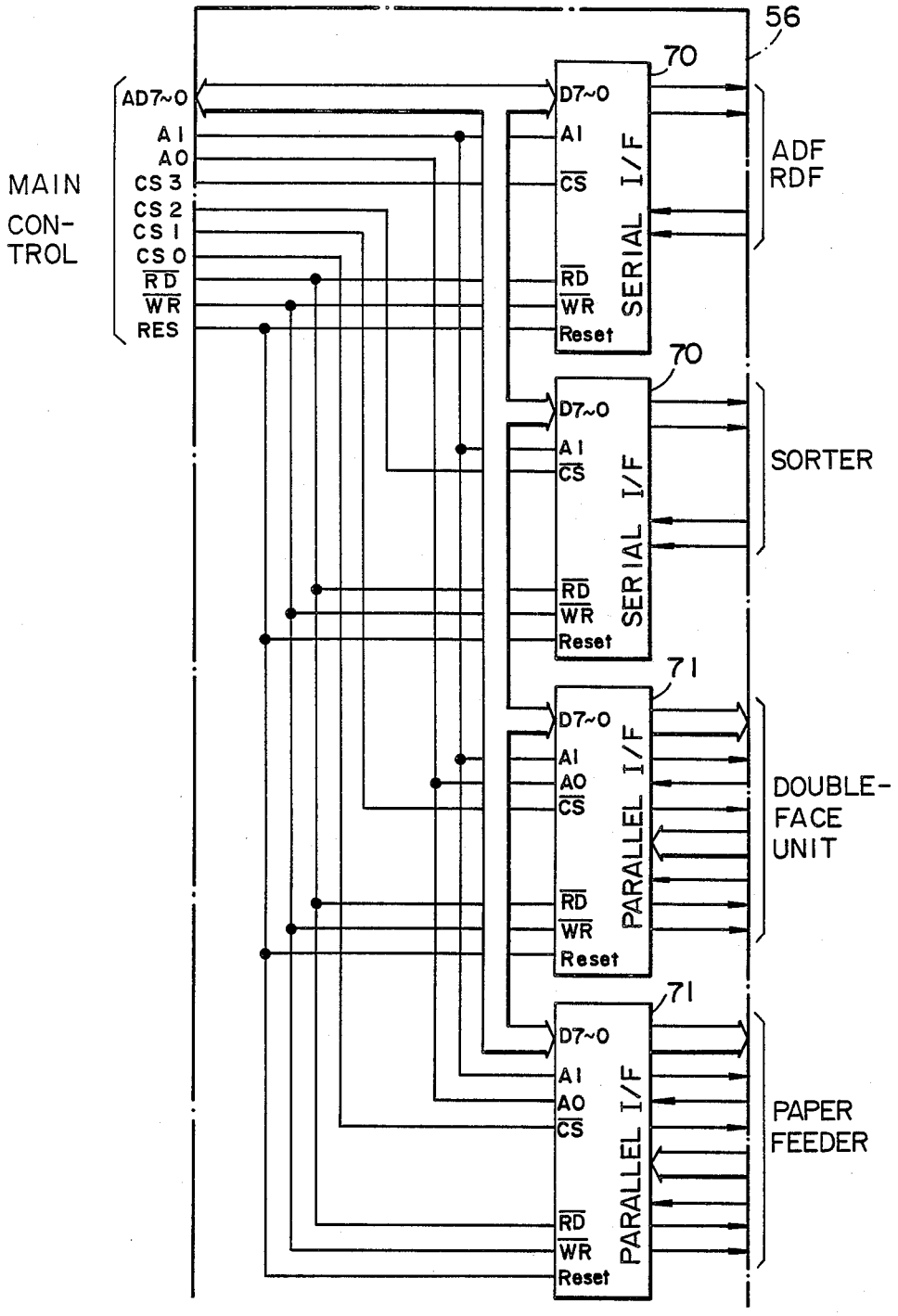
FIG. 4 is a block diagram showing an option board as shown in FIG. 2.

Referring to FIG. 4, a specific construction of the option board 56 of FIG. 2 is shown. As shown, the option board 56 comprises two serial interfaces 70, one assigned to the ADF (RDF) and the other to the sorter, and two parallel interfaces 71, one assigned to the double-face unit and the other to the paper feeder. The board 56 controls various optional devices in response to data coming in through a data bus (AD7-0) and control signals.

Figure 5:
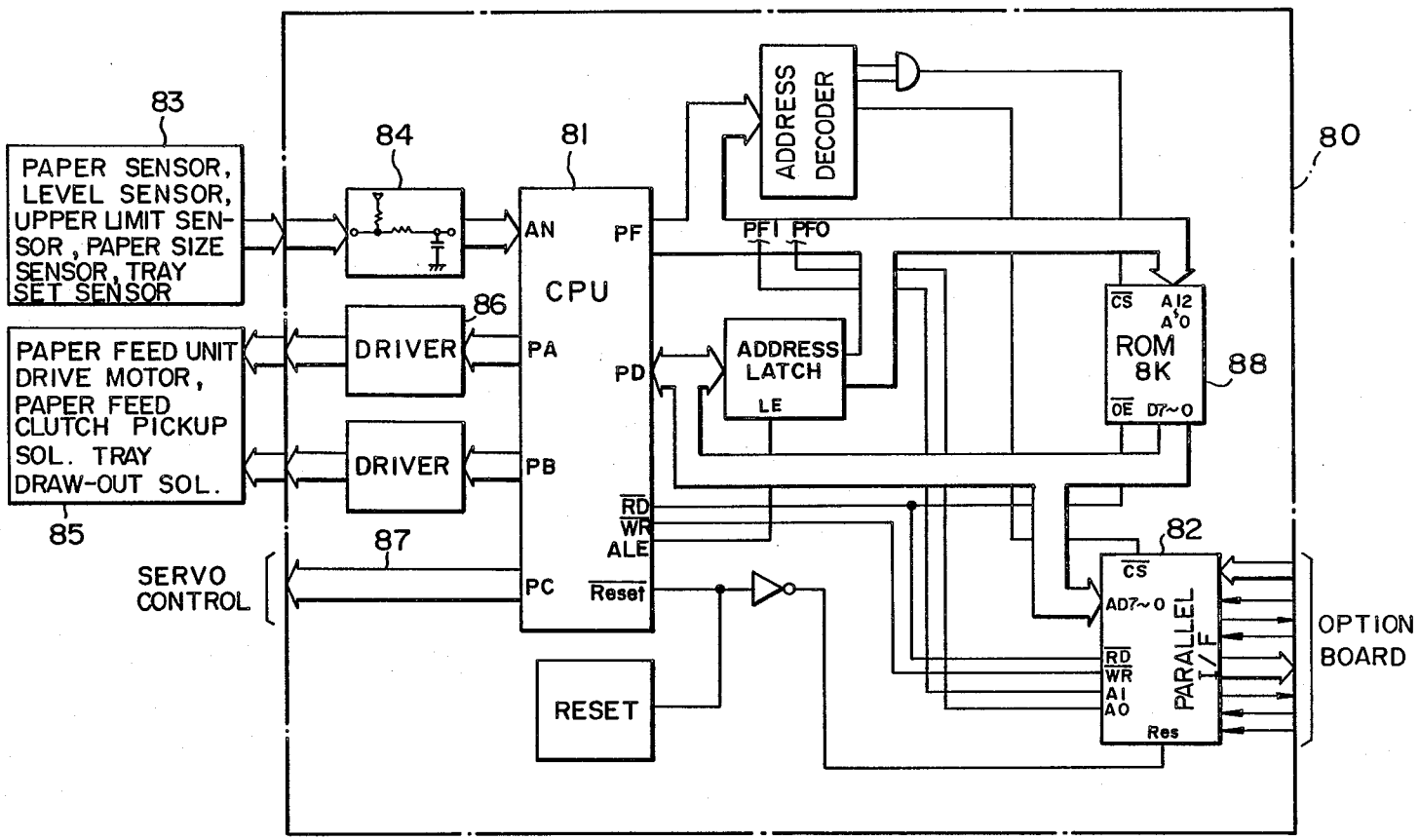
FIG. 5 is a block diagram of a control circuit which is associated with the paper feeder.

Referring to FIG. 5, there is shown a specific construction of a control circuit 80 associated with the paper feeder in accordance with the present invention. The control circuit 80 comprises a CPU 81, a ROM 88, and an I/O section (no numeral). The I/O section includes a parallel interface 82 for exchanging signals with the option board 56, an input circuit 84 to which output signals of sensors 83 which are distributed in the paper feeder are applied, a driver 86 for driving the motors, clutches, solenoids and other loads, and an interface 87 interfacing the circuit 80 to the DC servo motor control.

A specific construction of the motor control 55 as shown in FIG. 2 will be described with reference to FIG. 6.

Figure 6:
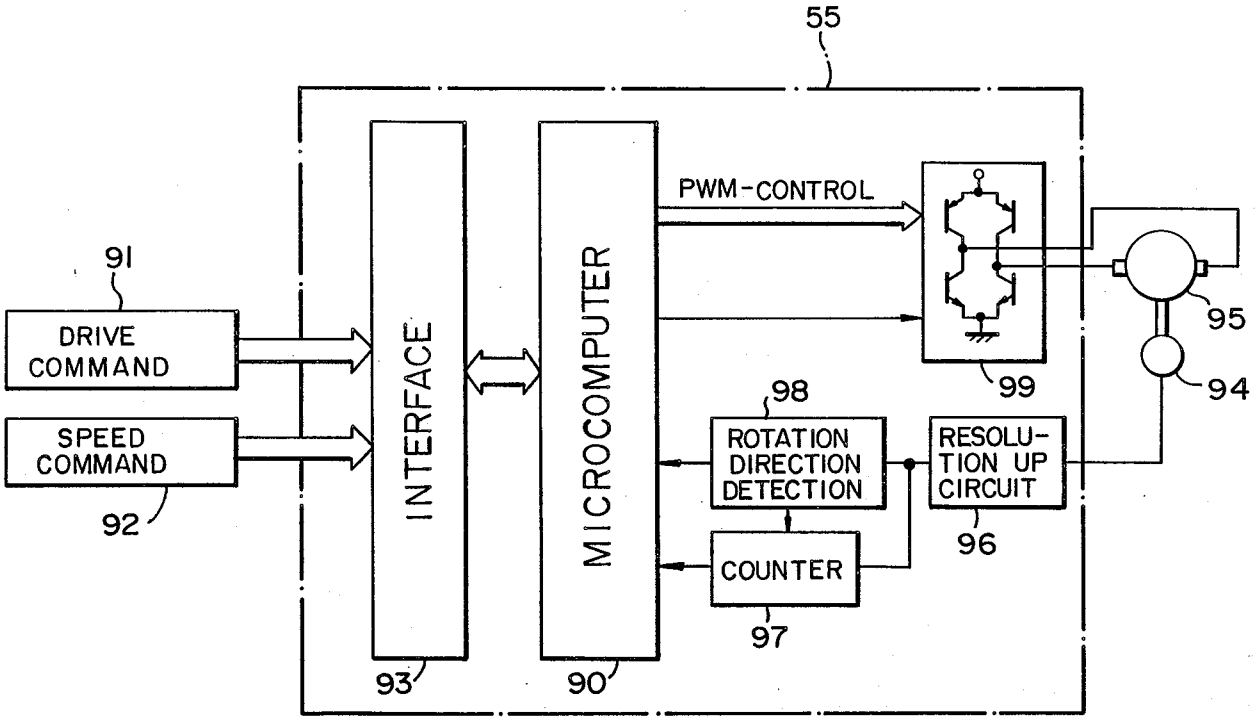
FIG. 6 is a block diagram of a motor control circuit representative of one embodiment of a control which is shown in FIG. 2.

In FIG. 6, a microcomputer 90 has a PWM control counter and a ROM built thereinside. The microcomputer 90 reads through an interface 93 an operation command signal 91 (motor on/off signal) and a speed command signal 92 which are delivered from the copier body, then measures the rotation speed of a motor 95 in response to an output of an encoder 94, then performs a calculation using the rotation speed and a speed command signal 92, and then PWM-controls the motor voltage (current). The output of the encoder 94 appears as a two-phase pulse sequence. A resolution up circuit 96 and a counter 97 cooperate to count the output pulses of the encoder 94, thereby determining a motor speed. At the same time, a sensor 98 senses a direction of motor rotation. The motor speed data produced as stated and the speed command signal 92 from the copier are processed together and, based on the result, the duty ratio of a pulse signal which is applied to a motor driver 99 is adjusted to set up a rotation speed which conforms to the speed command signal 92 without fail.

Where the speed command signal 92 is implemented with an eight-bit two-level signal, the motor is capable of rotating at any of sixty-four different speeds in total. This implies that a single paper feeder is selectively usable with copiers of different speeds only if a speed command signal representative of a paper transport speed of a copier used is fed to the motor control 55 of the paper feeder.

Figure 7:
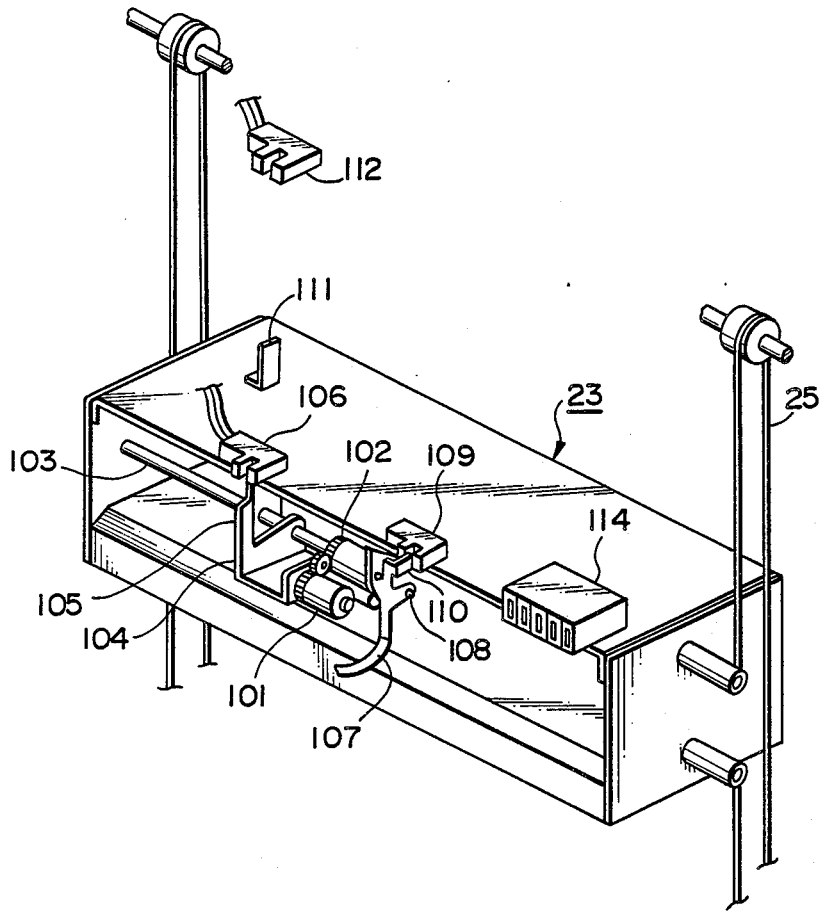
FIG. 7 is a perspective view of a paper feed unit.

Referring to FIG. 7, the paper feed unit 23 is shown in a perspective view. As shown, a pickup roller 101 is mounted on a bracket 104 which is rotatably mounted on a shaft 103 of a feed roller 102. The roller 101 is rotatable together with the roller 102. A level sensing section 105 is provided on the bracket 104 and includes a level sensor 106 adapted to sense a level, or height, of the pickup roller 101. A paper feeler 107 is rotatably mounted on a shaft 108 and includes an intercepting portion 110. A paper sensor 109 produces an output representative of presence of papers when intercepted by the portion 110 of the paper feeler 107. Further, an upper-limit intercepting plate 111 is provided on the top of the paper feed unit 23 while an upper-limit sensor 112 is mounted on a housing of paper feeder 200. The upper-limit position of the unit 23 is sensed when the plate 111 intercepts the sensor 112.

Hereinafter will be described operations for determining a level of the paper feed unit 23 and presence/absence of papers.

Figure 8:
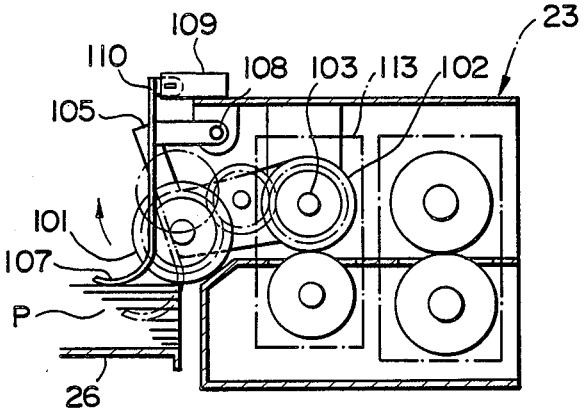
FIG. 8 is a section of the paper feed unit.

Referring to FIG. 8, the paper feed unit 23 is shown in a section. In response to a tray select command, the unit 23 is lowered to the level of a selected tray. As soon as the unit 23 reaches the tray 26, the paper feeler 107 first makes contact with papers P stacked on the tray 26 and, as the unit 23 is further lowered, it is rotated clockwise about the shaft 108 with the result that the intercepting portion 110 intercepts the paper sensor 109 to indicate presence of papers. Subsequently, the pickup roller 101 is brought into contact with the papers and, as the unit 23 is lowered, the level sensing section 105 of the bracket 104 is rotated about the shaft 103 of the feed roller 102 to intercept the level sensor 106. At this instant, the downward movement of the paper feed unit 23 is stopped.

A paper size sensor 114 is mounted on the paper feed unit 23. The sensor 114 is of a reflection type and provided with a plurality of pairs of light emitting and light receiving sections. Each of the trays, on the other hand, is provided with a reflector which is associated with the size of papers stacked in the tray. The sensor 114 cooperates with the reflectors to sense the sizes of papers stored in the respective trays.

Figure 9:
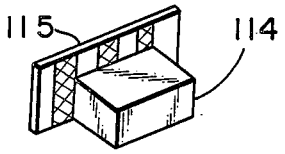
FIG. 9 is a perspective view of a paper size sensor.

FIG. 9 shows a relationship between the paper size sensor 114 and a reflector 115 which is attached to any of the trays. As shown, the reflector 115 is provided with a black-and-white pattern which is representative of a particular paper size to be sensed by the sensor 114.

Figure 10:
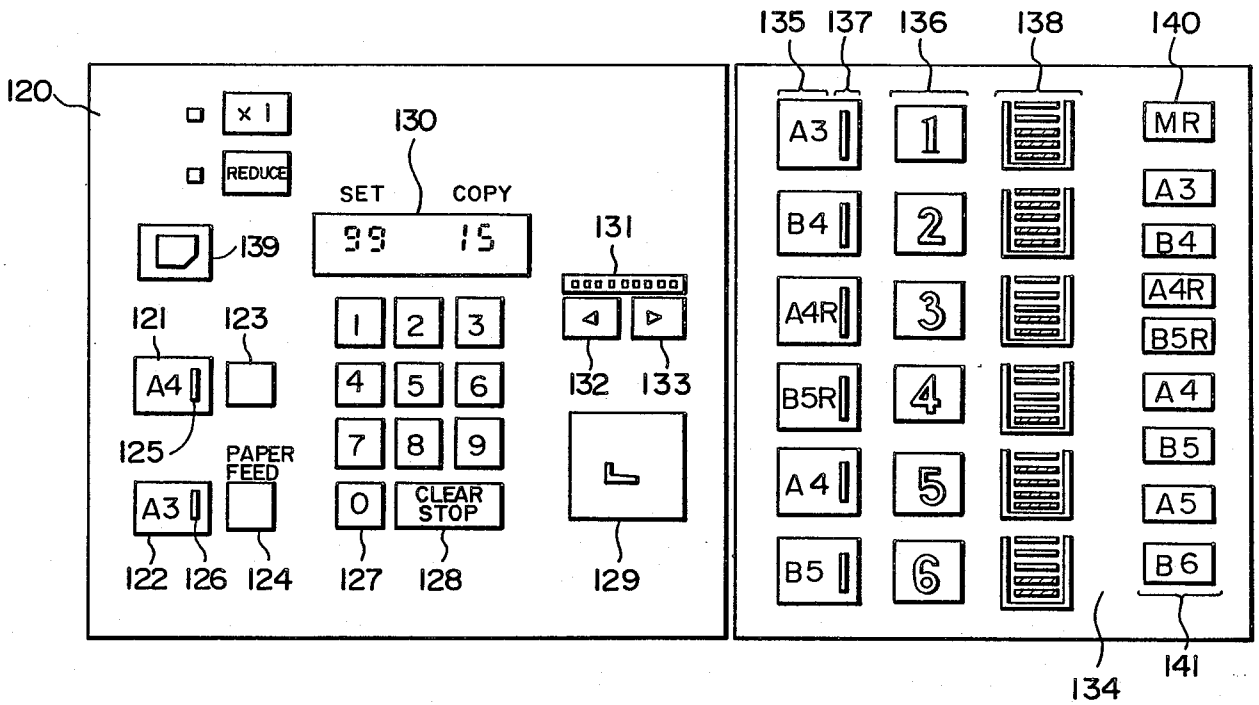
FIG. 10 is a plan view of a control panel of the copier.

Referring to FIG. 10, a control panel 120 mounted on the copier 100 is schematically shown. Arranged on the control panel 120 are copy size indication lamps 121 and 122, paper cassette selection keys 123 and 124, feed position indication lamps 125 and 126, numeral keys (0 to 9) 127, a clear/stop key 128, a print key and copy ready/unready indication lamp 129, a copy number and set number display 130, a copy density display 131, a dark key 132 for increasing the density, an a light key 133 for decreasing the density, etc.

In accordance with the present invention, when it is desired to use the paper feeder 200 with the copier 100, an exclusive control panel 134 adapted for the paper feeder 200 may be mounted next to the control panel 120. The control panel 134 has thereon paper size indication lamps 135 which are associated one-to-one with the sizes of papers stored in the respective trays of the paper feeder 200, tray selection keys 136, feed position indication lamps 137 for displaying a selected tray, and remaining amount indication lamps 138 for displaying remaining amounts of papers in their associated trays. While in this particular embodiment the control panel 120 of the copier 100 is not provided with remaining amount indication lamps (since one can readily see remaining amounts of papers), such lamps may naturally be furnished with. The paper size indication lamps 135 are implemented with a dot display of the kind using light emitting diodes or liquid crystal, so that the different paper sizes as well as paper end are displayed by a single display.

In accordance with the present invention, the paper feed unit drive motor 32 installed in the unit 200 is implemented with a pulse motor. A position of the unit 23 can be determined with accuracy by counting drive pulses applied to the pulse motor with the turn-on position of the upper limit sensor 112 as a reference.

The operation of the paper feed unit 23 will be described with reference to FIGS. 11A to 11D.

Figure 11A:
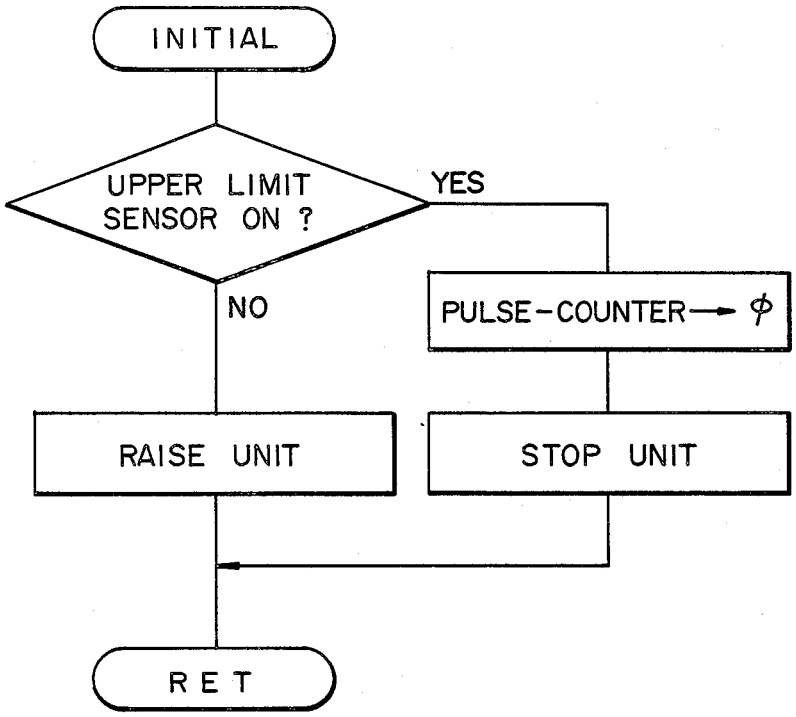
FIGS. 11A to 11D are flowcharts demonstrating operations of the paper feed unit.
Figure 11B:
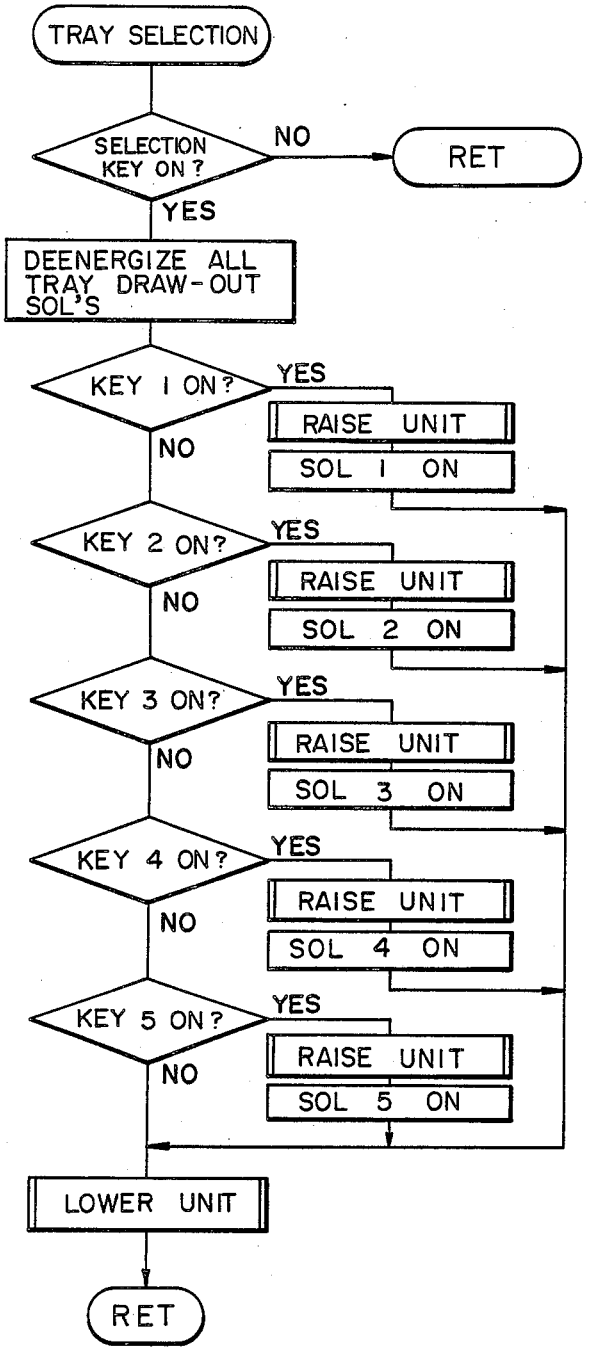

FIG. 11A is a flowchart demonstrating a control which is performed on the unit 23 upon turn-on of a power source. If the upper limit sensor 112 is not turned on, the unit 23 is raised until the sensor 112 becomes turned on. At this instant, the counter associated with the pulse motor is reset to "0". FIG. 11B is a flowchart representative of operations of tray draw-out solenoids which occur in the event of tray selection. As any of the tray selection keys 1 to 6 on the control panel 134 is depressed, the unit 23 is elevated to a level above the selected tray (except when the selected tray is located below the currently selected tray), then one of the solenoids associated with the selected tray is energized to draw out the tray to the paper feed position, and then the unit 23 is lowered. It is to be noted that the tray 6 on the display (tray 31 in FIG. 1) is not provided with a solenoid since it is constantly located at the paper feed position; when the tray 6 is selected, the solenoids assigned to the other trays 1 to 5 are deenergized to retract them and, then, the unit 23 begins to be lowered.

Figure 11C:
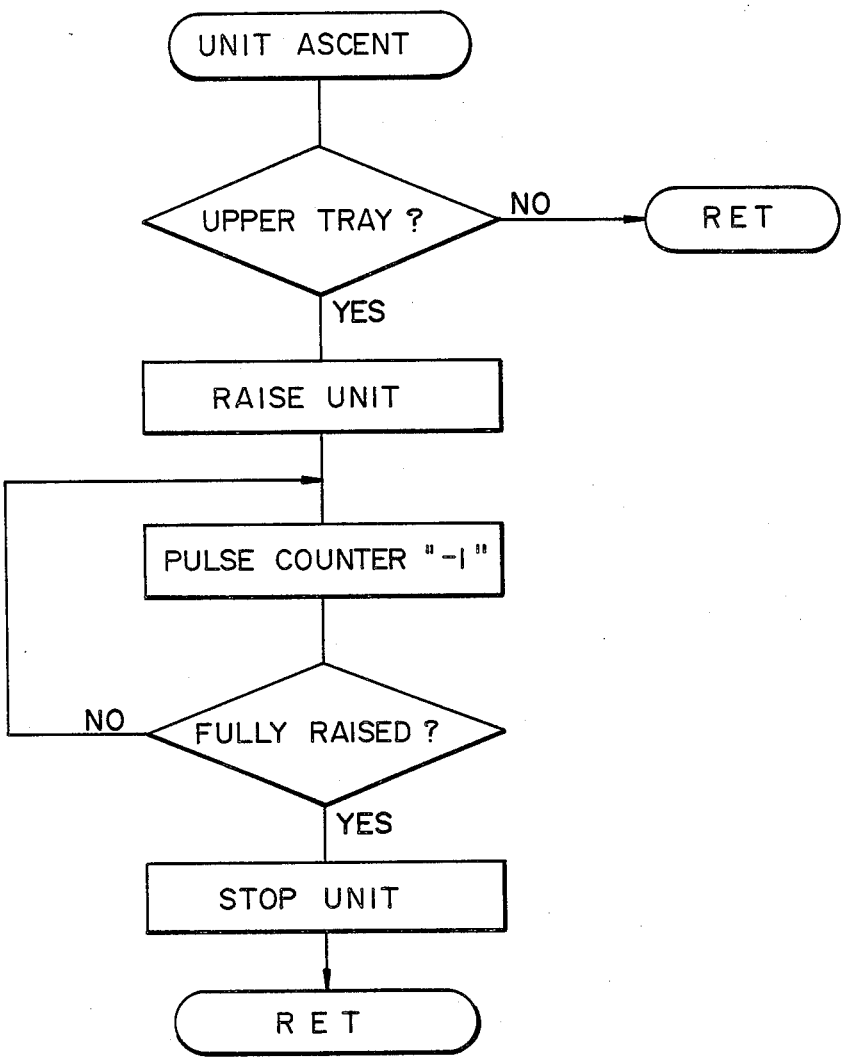
Figure 11D:
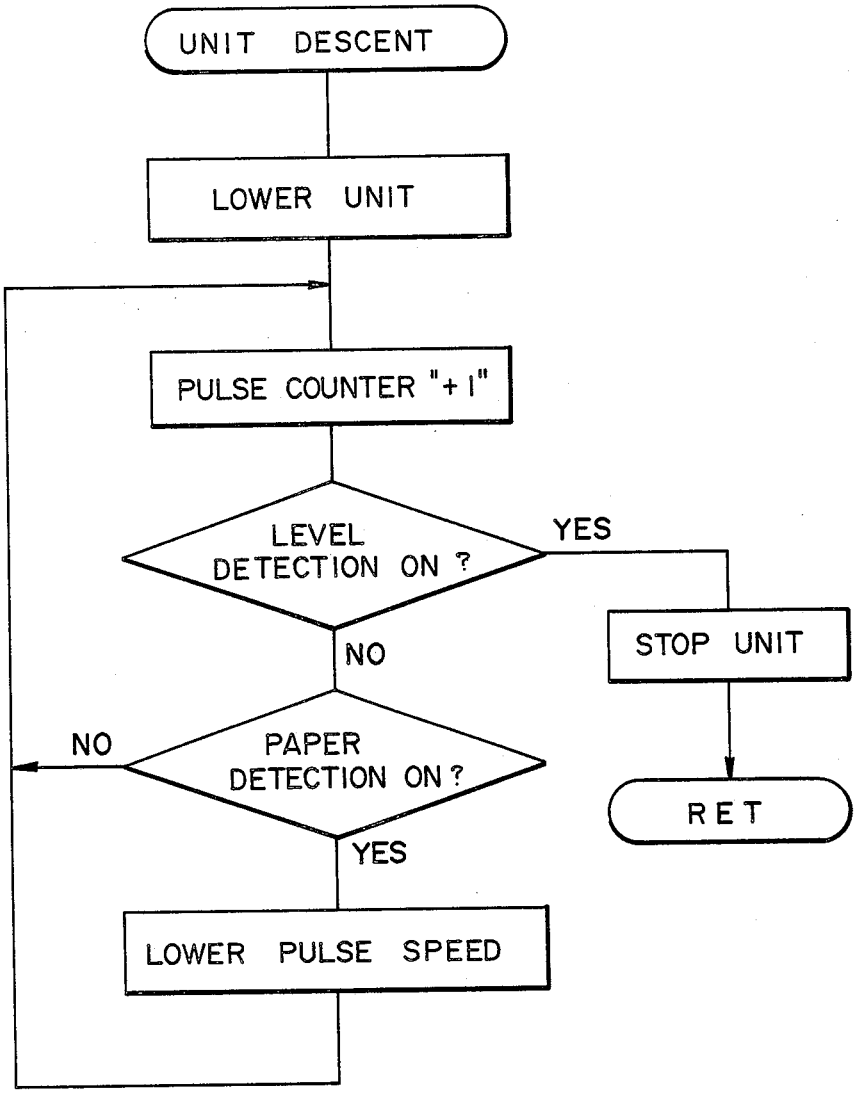

FIG. 11C is a flowchart demonstrating a unit elevation subroutine. When any of the trays which is located above the currently selected one is selected, the pulse motor is driven in a direction for elevating the unit 23 and, at this instant, the drive pulse counter is decremented (−1). As soon as the unit 23 reaches a predetermined position associated with the selected tray, the pulse motor is deenergized. It will be needless to mention that when the tray selected is positioned below the currently selected one, it is needless to elevate the unit 23. FIG. 11D is a flowchart showing a unit descent subroutine. In this subroutine, the pulse motor is driven in a direction for lowering the unit 23 while the drive pulse counter is incremented (+1).

When papers are present, the paper sensor is turned on during the descent of the unit 23 and, then, the level sensor of the unit 23 is turned on. Utilizing such a time lag, the unit 23 is decelerated to be stopped smoothly and with accuracy. This kind of stop control system which ensures constant deceleration is especially effective in the case where the stop position of the unit depends on the selected tray and the amount of papers stacked on the tray as in the illustrative embodiment.

Figures 12, 12A:
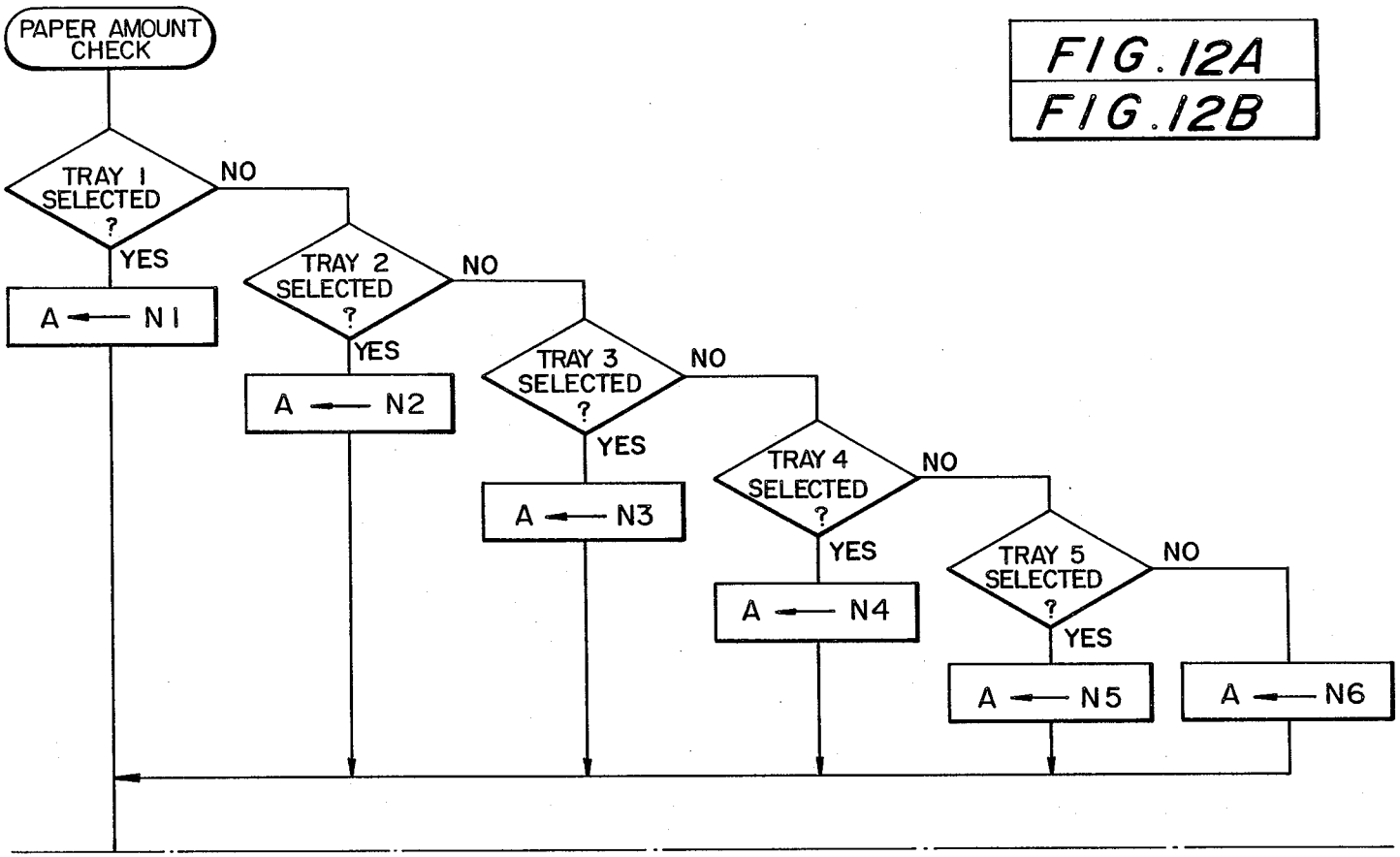
FIGS. 12, 12A and 12B are a flowchart showing a routine for detecting amounts of papers which are remaining in trays.
Figure 12B:
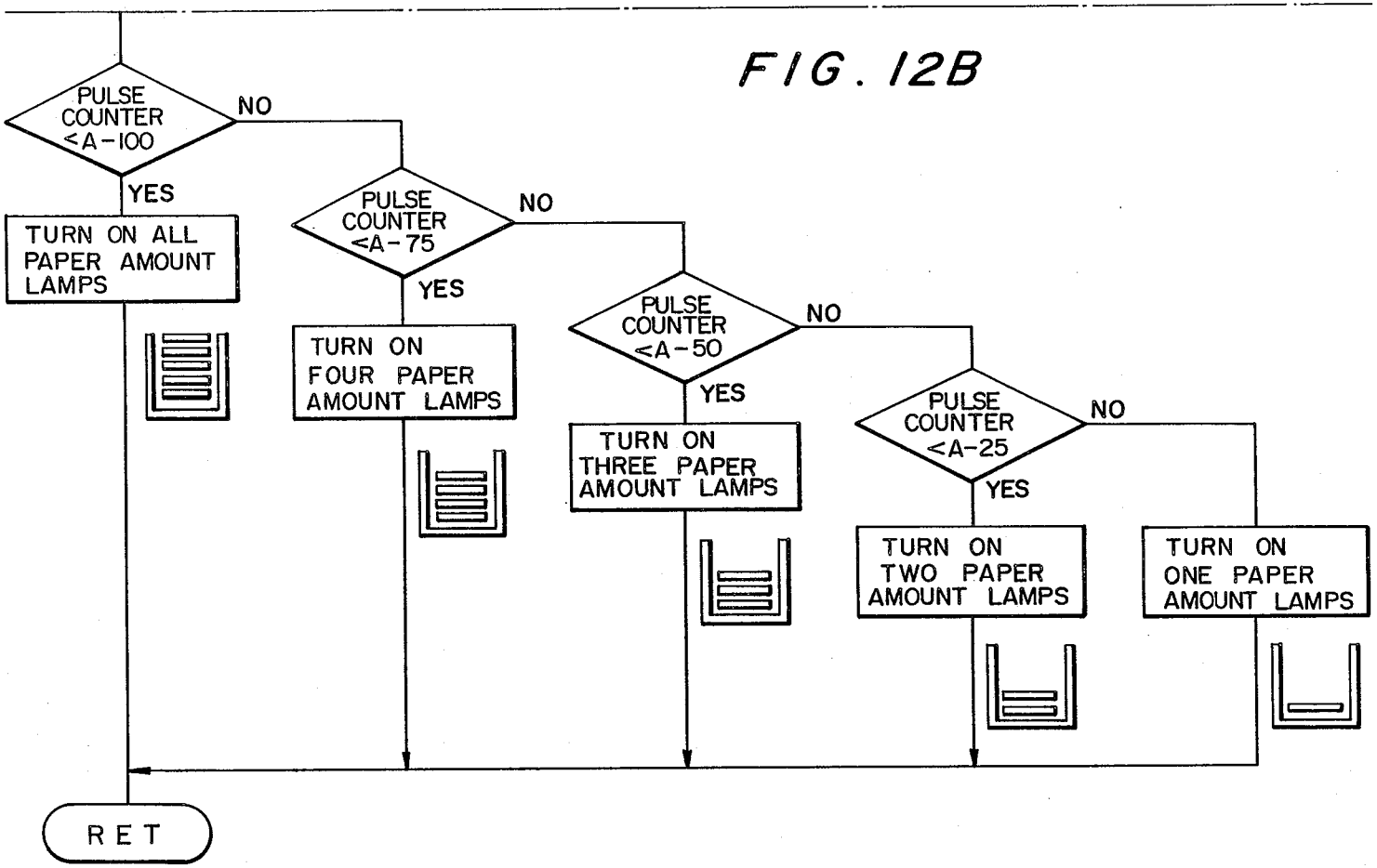

Referring to FIG. 12, a flowchart representative of a paper amount detection routine is shown. The amount of remaining papers in any of the trays is detected in terms of the count of the drive pulse counter of the instant when the unit 23 has been stopped at the selected tray. The count of the counter decreases as the level of the unit 23 increases and sequentially increases as the unit 23 lowers. That is, the greater the amount of remaining papers, the smaller the count of the counter; as the amount of remaining papers decreases, the count increases. In FIG. 12, N1 to N6 are respectively representative of counts of the counter under a condition wherein the trays 1 to 6 are empty, i.e. reference values for the detection of paper amounts. The routine of FIG. 12 begins with storing in an A register of the CPU any of the values N1 to N6 according to one of the trays selected. Then, the content of the pulse counter and that of the A register are compared to determine an amount of remaining papers, whereafter one of the paper amount indication lamps on the control panel 134 which is associated with the selected tray is turned on.

Figure 13:
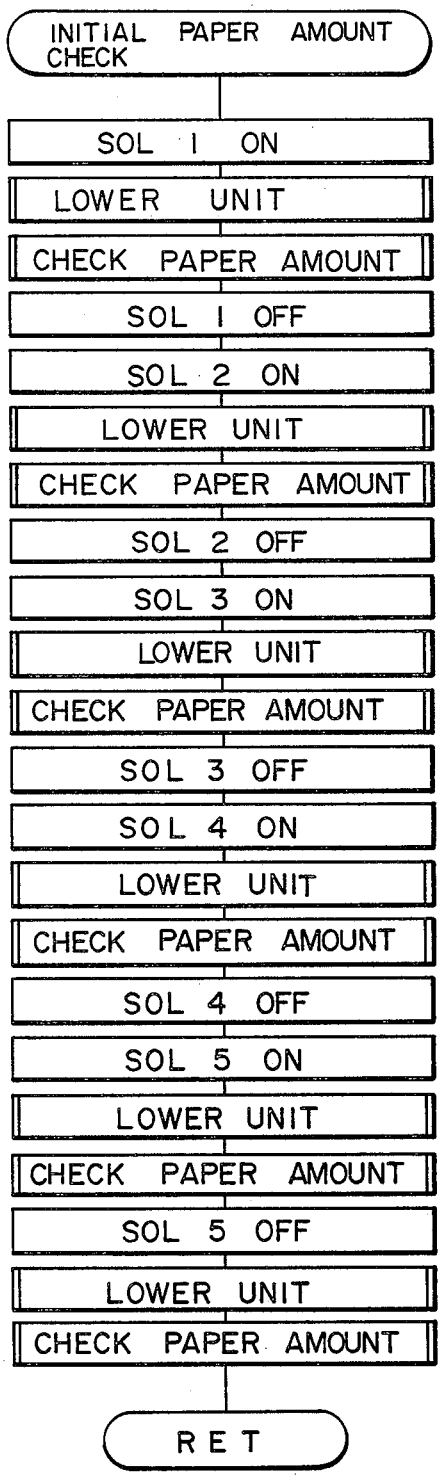
FIG. 13 is a flowchart of a subroutine for detecting remaining amounts of paper upon turn-on of a power source.

Referring to FIG. 13, there is shown a flowchart demonstrating a paper amount detection subroutine which is executed upon turn-on of the power source. The subroutine of FIG. 13 is executed after the initial routine of FIG. 11A. Specifically, the amounts of remaining papers in the trays 1 to 6 are checked one after another while the paper amounts indication lamps on the control panel 134 are turned on. Because this procedure is completed during a fixing heater warm-up period immediately after the turn-on of the power source, it does not increase the waiting time at all.

In summary, it will be seen that in accordance with the present invention a paper feed unit of a paper feeder can be stopped with accuracy at a paper feed position without resorting to a decrease in travelling speed. The amount of remaining paper in each of trays can be detected with accuracy and at low cost without the need for special sensing elements otherwise associated with the respective trays. Further, the detection of amounts of remaining papers in accordance with the present invention enhances operating efficiency since the amounts are detected and displayed immediately after the turn-on of power and prior to copying operation.

Various modifications will become possible for those skilled in the art after receiving the teachings of the present disclosure without departing from the scope thereof.

What is claimed is:

1. A paper feeder joined with an independent apparatus for feeding papers to said apparatus, comprising:

a plurality of trays arranged sequentially one above another and each capable of being moved from a non-feed position to a feeding position;

a paper feed unit located in front of said trays for feeding papers out of said trays;

a drive motor for elevating and lowering said paper feed unit;

a paper sensor associated with each of said plurality of trays for sensing presence or absence of papers; and a level sensor for sensing a position of said paper feed unit, means for actuating said drive motor to move said paper feed unit to a desired position adjacent a selected tray, said paper sensor associated with said selected tray being actuated prior to said level sensor during movement of paper feed unit and means for decelerating such drive motor prior to arrival at said desired position when said associated paper sensor detects the presence of paper at said desired position.

2. A paper feeder as claimed in claim 1, wherein said drive motor comprises a pulse motor, an amount of papers remaining in each of said trays being detected and displayed by counting drive pulses applied to said pulse motor.

3. A paper feeder as claimed in claim 2, wherein after a power source has been turned on amounts of papers remaining in all of said trays are detected during a power on sequence of said independent apparatus and displayed prior to the operation of said independent apparatus.

* * * * *